US005392615A

United States Patent [19]

Lim

[11] Patent Number: 5,392,615

[45] Date of Patent: Feb. 28, 1995

[54] AIR CONDUIT SYSTEM IN A REFRIGERATOR

[75] Inventor: Jae H. Lim, Suwon, Rep. of Korea

[73] Assignee: Samsung Electronics Co., Ltd., Suwon, Rep. of Korea

[21] Appl. No.: 124,540

[22] Filed: Sep. 22, 1993

[30] Foreign Application Priority Data

Sep. 23, 1992 [KR] Rep. of Korea ..... 92-17334

[51] Int. Cl.[6] ..... F25B 29/00

[52] U.S. Cl. ..... 62/414; 62/408

[58] Field of Search ..... 62/407, 408, 404, 413, 62/414, 419, 382, 331, 440, 441; 165/2, 30

[56] References Cited

U.S. PATENT DOCUMENTS

| | | | |
|---|---|---|---|
| 3,015,215 | 1/1962 | Tobey | 62/408 |
| 3,364,694 | 1/1968 | Cohen et al. | 62/408 |
| 3,403,533 | 10/1968 | Bollenbacher | 62/408 |
| 3,473,345 | 10/1969 | Pfeiffer et al. | 62/408 |
| 3,600,905 | 8/1971 | Dymek et al. | 62/382 |
| 3,638,717 | 2/1972 | Harbour et al. | 165/30 |
| 4,616,557 | 10/1986 | Paoluccio | 62/414 X |
| 5,228,499 | 7/1993 | Yoon | 165/2 |

*Primary Examiner*—Henry A. Bennett
*Assistant Examiner*—William C. Doerrler
*Attorney, Agent, or Firm*—Burns, Doane, Swecker & Mathis

[57] ABSTRACT

A refrigerator includes a refrigerating compartment and a storage compartment disposed therebeneath. A first cool air path conducts cool air from a main cool air duct to the storage compartment and then to the refrigerating compartment. A second cool air path conducts cool air directly from the main duct to the refrigerating compartment. The cool air entering the refrigerating compartment from the second path is cooler than, and travels faster than, the cool air entering the refrigerating compartment from the first path to create a pressure differential which induces the air flow through the first path.

8 Claims, 2 Drawing Sheets

AIR CONDUIT SYSTEM IN A REFRIGERATOR

FIELD OF THE INVENTION

The present invention is related to a refrigerator which includes a refrigerating compartment and at least one storage compartment located therebeneath. Cool air is conducted downwardly to the storage compartment and then upwardly to the refrigerating compartment.

BACKGROUND OF THE INVENTION

A refrigerator is utilized to store various foodstuffs under either a frozen or a refrigerated condition to extend the freshness of the foodstuffs stored in the compartment. Such a refrigerator consists of one of two cooling types, one of which is a direct cooling type, that is, the evaporator in a refrigerating cycle is installed in a foodstuff storage space and a direct heat-exchange is achieved. Another type of cooling is the indirect cooling type, that is, the evaporator is mounted in a passage which is separated from the foodstuff space and the air is heat-exchanged by the evaporator and then the heat-exchanged air is flowed to the foodstuff storage space by means of a fan.

The above refrigerator normally consists of a freezing compartment and a refrigerating compartment, one located above the other. Further, the refrigerating compartment is provided with a separate space, having a different temperature from that of the refrigerating compartment, known as a "vegetable compartment" or a "chilled compartment" which stores meats etc. The foodstuffs can be separately stored in the space in accordance with the desired conditions. On the front surface of both the freezing compartment and the refrigerating compartment a door is installed. The doors hings an one center vertical side shafts of the doors in order to provide access to the foodstuffs in the respective compartment.

In the above conventional refrigerator, the space for storing the foodstuffs separately is restricted within the freezing compartment and the refrigerating compartment. The space is so small that the desire of the user, following the current trend for foodstuffs which are stored under a "fresh" condition, can not be satisfied. To solve this problem, to refrigerator having a large number of separate compartments has recently been developed.

The refrigerator is used for expanding the storage space in order to allow the foodstuffs to be stored in accordance with the temperature range corresponding to the individual characteristic of the specific foodstuffs, and for making the operation of the door convenient. The typical refrigerator has an advantage resulting from the increase in the storage volume and the convenience of the door operation. However, it has a problem in that various types of fermented foodstuffs, e.g. kimchi, may be stored together with other foodstuffs in the same space.

Kimchi is a mixed vegetable dish of picked vegetables combined with various seasonings. Kimchi is usually stored in a case and is fermented at room temperature to fully develop the taste of kimchi. The cured kimchi is then stored in a refrigerator. Since kimchi is usually made in a voluminous and heavy amount, a large storage space is required to store kimchi. When foodstuffs stored alongside the kimchi container are removed or inserted, the kimchi container interferes with the placement of the foodstuffs. Particularly, as kimchi is being fermented, kimchi produces a unique odor which is contained in the cool air circulated in the compartment. There is a problem in that the odor often adversely affects other foodstuffs.

Further, when the door is opened so as to put in or take out foodstuffs, the odor is diffused from the compartment, thereby causing the user displeasure. Also, the relatively large door must be opened to remove the relatively small amount of foodstuff and thus a great deal of cool air escapes so that the efficiency of the refrigerator is reduced.

To resolve the above defect, a refrigerator having a separate compartment which is located between the freezing compartment and the refrigerating compartment was developed. The arrangement of compartments is as described below. A freezing compartment is located at the top of the unit and an evaporator is installed in the rear of the freezing compartment. Beneath the freezing compartment a refrigerating compartment is located for connecting with the evaporator. Under the refrigerating compartment is located a separated or kimchi compartment which is operated by an additional refrigerating cycle. The vegetable compartment is located under the kimchi compartment for connection with the evaporator and the refrigerating compartment.

Owing to the characteristics of the kimchi compartment, it must be isolated from other compartments (the refrigerating compartment, the vegetable compartment etc.) of the refrigerator. Thus, in the rear wall of the kimchi compartment an air duct is located which extends from the evaporator mounted behind the freezing compartment to the vegetable compartment located in the lower part of the refrigerator. The air directed into the vegetable compartment via the air duct flows into the refrigerating compartment. Because the air duct extends a relatively long distance, the movement of the air is slow. Thus, it has a problem in that the active cooling of the vegetable compartment cannot be obtained due to the slow air movement.

Moreover, in this structural refrigerator, the temperature of the air which flows into the refrigerating compartment after passing through the vegetable compartment is relatively higher than that of the air which directly enters into the refrigerating compartment. Moreover, due to the temperature variation that occurs in the refrigerating compartment, another problem is that it has a bad effect on the other foodstuffs which are stored in the refrigerating compartment.

SUMMARY OF THE INVENTION

The present invention provides a refrigerator which easily and effectively solves the above mentioned problems.

The object of the present invention is to provide a refrigerator in which an air opening is provided so that the air circulating from the vegetable compartment is directed into the refrigerating compartment by the difference in pressure between the first air flow and a second air flow which flows directly to the refrigerating compartment.

Another object of the present invention is to provide a refrigerator in which the relatively warmer air circulated via the vegetable compartment into the refrigerating compartment is mixed with the relatively cool air which flows directly into the refrigerating compartment, and the relatively warmer air is converted into air with an uniform temperature to be directed into the refrigerating compartment, thereby allowing foodstuffs to be stored for a long period of time.

According to the present invention, the refrigerator comprises a refrigerating compartment, a freezing compartment located separately and above the refrigerating compartment, a storage compartment located separately and beneath the refrigerating compartment, an opening to a main air duct located in the rear wall of the refrigerating compartment for introducing cold air generated by an evaporator into the refrigerating compartment, a first sub-duct interconnected with the main duct for introducing some of the cold air into the storage compartment, a second sub-duct interconnected with the storage compartment and having an opening for introducing the cold air in the storage compartment into the refrigerating compartment, and the opening for the second sub-duct located near the main duct opening.

Further, the storage compartment is used for storing vegetables.

In the refrigerator, the velocity of the air passing the main duct opening is relatively higher than that of the air passing through the opening of the second air duct. Further, the temperature of the latter air is relatively higher than that of the former air. Therefore, the pressure of the air passing the opening of the second air duct is relatively higher than that of the air passing through the main air duct opening. Thus, the air with the relatively higher pressure naturally moves toward the air having the relatively low pressure.

DETAILED DESCRIPTION OF THE PREFERRED EMBODIMENT

Figure 1:
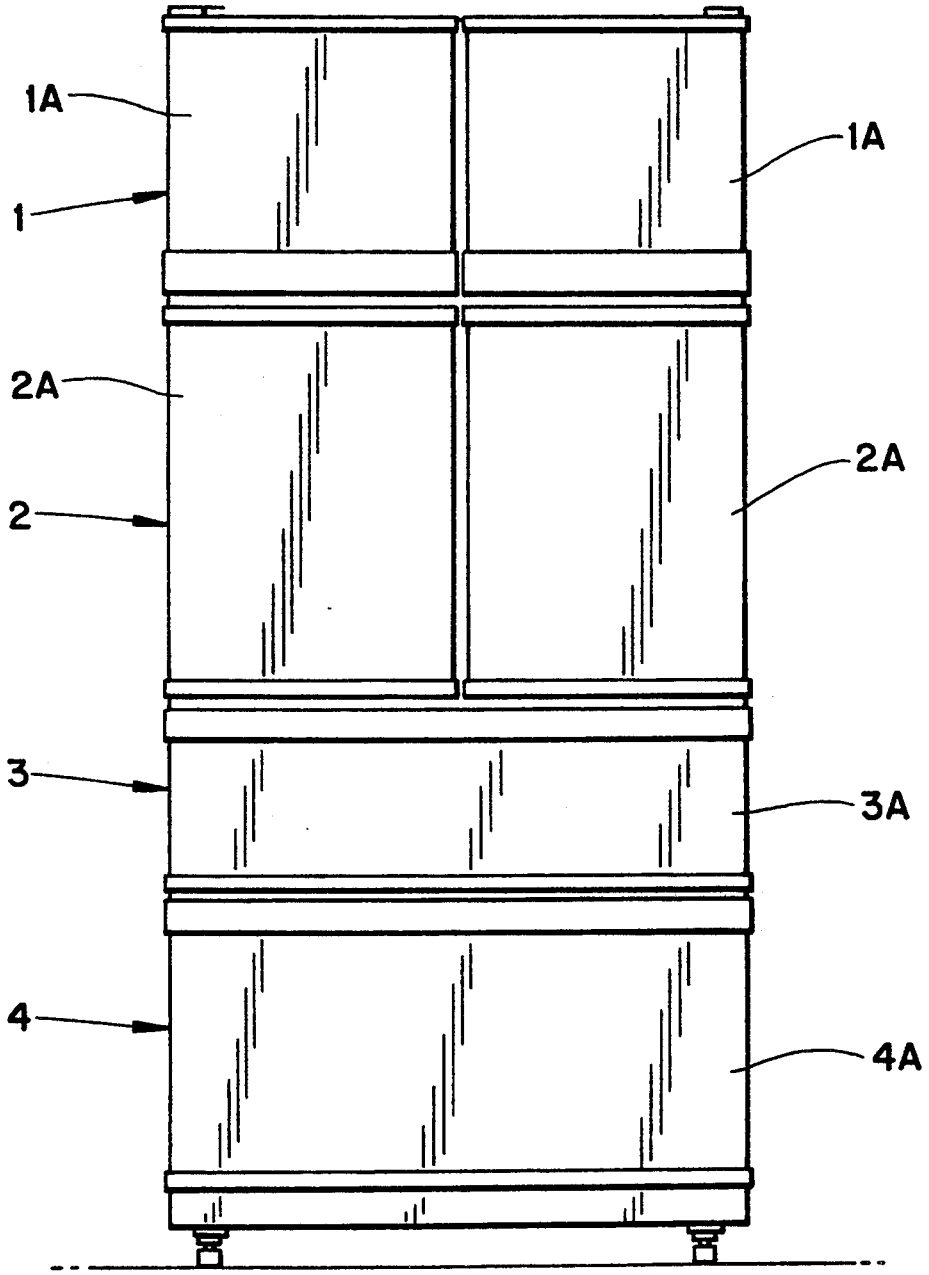
FIG. 1 is a front view representing the embodiment of the present invention as adapted to the refrigerator.
Figure 2:
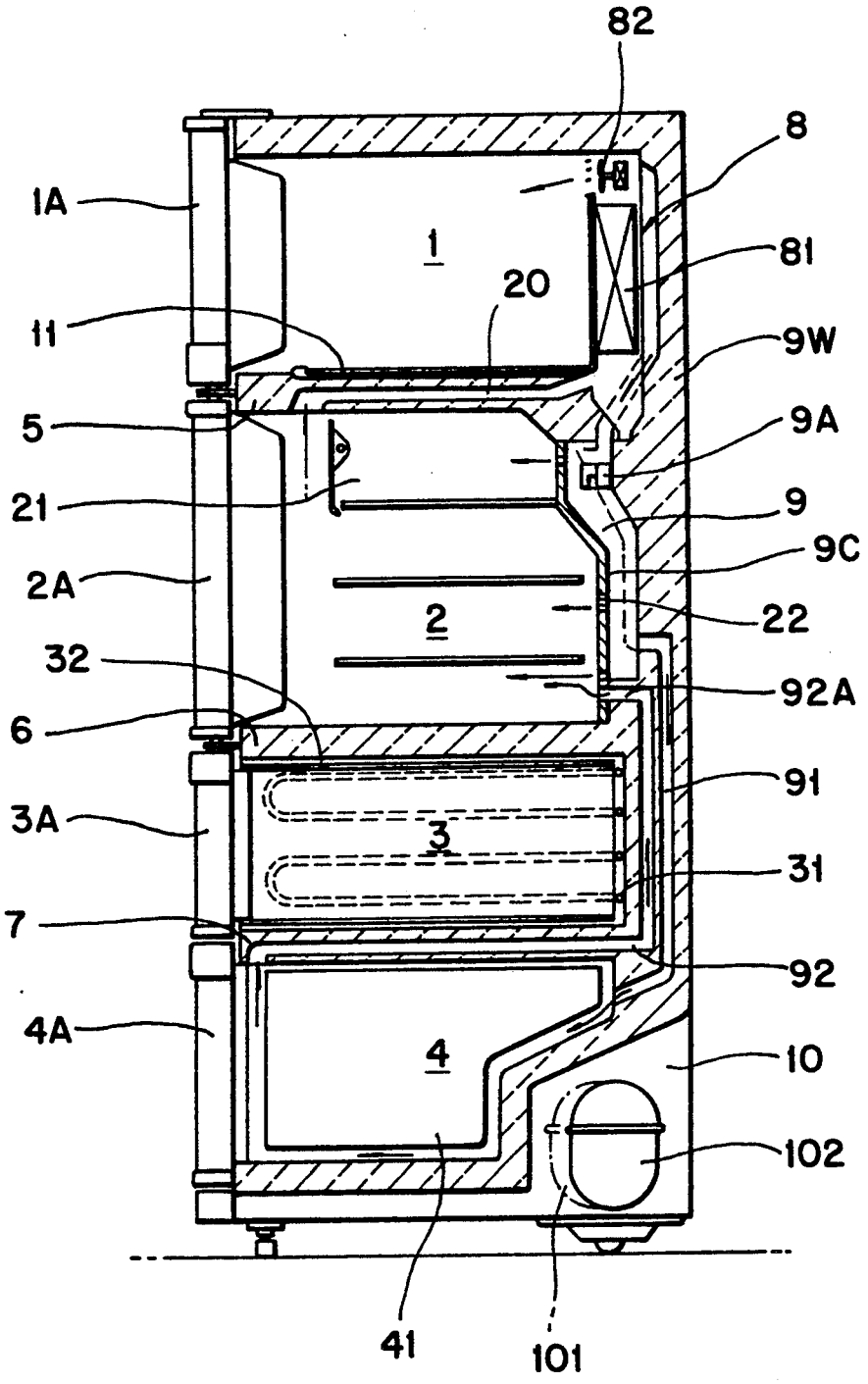
FIG. 2 is a crosssectional view representing the embodiment according to the present invention.

The refrigerator includes freezing compartment 1, refrigerating compartment 2, kimchi compartment 3 and vegetable compartment 4 which are vertically superposed one upon the other. The freezing compartment 1 and the refrigerating compartment 2 are equipped with doors 1A, 2A at the front portion of the compartments 1,2, respectively. Each door 1A, 2A is hinged along the vertical axis on a sides of each compartment. The kimchi compartment 3 has a door 3A, at the front of the kimchi compartment 3, which is hinged along the lower horizontal corner of the door 3A. The vegetable compartment 4 has a door 4A, at the front of the vegetable compartment 4, which is integrally formed to be a part of the vegetable box 41 for sliding it forward or backward.

Further, a first partition wall 5 is formed between the freezing compartment 1 and the refrigerating compartment 2, a second partition wall 6 between the refrigerating compartment 2 and the kimchi compartment 3, and a third partition wall 7 is between the kimchi compartment 3 and the vegetable compartment 4. This structure is intended to reduce the heat transfer between compartments 1, 2, 3 and 4. At the rear wall of the freezing compartment 1 is provided a heat-exchanging compartment 8 which has an evaporator 81 and a fan 82. The cold air heat-exchanged at the evaporator 81 is circulated throughout each compartment by the use of ducts. A duct arrangement for air circulation is explained below.

A main duct 9 is provided at the rear wall 9W of the refrigerating compartment 2 and is connected to the heat-exchanging compartment 8. The air supplied from the evaporator 81 is controlled by a thermodamper 9A which is installed in the rear of a chilled space 21 of the refrigerating compartment 2. A duct cover 9C is mounted in front of and spaced from the rear wall 9W in order to create the main duct 9. Formed in the duct cover 9C is an opening 22 of the main duct 9 which allows cold air to enter into the refrigerating compartment 2. In the upper portion of the first partition wall 5, adjacent to the freezing compartment 1, an air duct 11 is provided by which the air from the freezing compartment 1 flows back to the heat-exchanging compartment 8. The main duct 9 is extended downward as a first sub-duct 91 which is connected to the vegetable compartment 4.

A second sub-duct 92 is located in the third partition wall 7 disposed above the vegetable compartment 4 connects the vegetable compartment 4 with the refrigerating compartment 2. An opening 92A of the second sub-duct 92, which connects the second sub-duct 92 with the refrigerating compartment 2, is located near the opening 22 of the main duct 9. In the lower portion of the first partition wall 5, adjacent to the refrigerating compartment 2, an air duct 20 is provided by which the air via the refrigerating compartment 2 flows back into the heat-exchanging compartment 8. The cold air circulated by the above-described indirect cooling method is achieved by forced convection by the fan 82.

The kimchi compartment 3 is located between the refrigerating compartment 2 and the vegetable compartment 4 and comprises an evaporating pipe 31 embedded in the interior surfaces of the rear vertical wall and both side vertical walls of the kimchi compartment. The kimchi compartment 3 further comprises a heater 32 which is located on an exterior surfaces of the upper plate and the lower plate. The evaporator 31 receives refrigerant from a second compressor 102 which is specially adapted for the kimchi compartment 3. Thus, the air in the kimchi compartment can be cooled by a heat-exchange with the evaporator 31. The kimchi is fermented by heat from the heater 32 and the cured kimchi is stored at a lower temperature.

The operation of the above structural refrigerator will now be explained with reference to the attached drawings.

For the circulation of cold air in the freezing compartment 1, the refrigerating compartment 2 and the vegetable compartment 4, the refrigerant is compressed by a first compressor 101 which is installed in the machine storage compartment 10. The compressed refrigerant is circulated through a condenser and a capillary tube which are not illustrated in drawings, and is converted into a low pressure refrigerant with a low temperature. The refrigerant is circulated back into the first compressor 101 via the evaporator 81.

In this cycle, the air is circulated into the heat-exchanging compartment 8 from each compartment so as to be heat-exchanged. The air in the heat-exchanging compartment 8 is then moved by the fan 82 toward the freezing compartment 1. The air makes the freezing compartment 1 cool and it is then led to the heat-exchanging compartment 8 via the air duct 11.

When the thermodamper 9A senses that temperature of the refrigerating compartment 2 has reached a specific value, the thermodamper opens and air from the heat-exchanging compartment 8 is circulated into the main duct 9 and a part of that air is directed to the refrigerating compartment 2 through opening 22 in the direction of the arrow. Simultaneously, another part of the air is circulated into the vegetable compartment 4 through the first sub-duct 91. The air in the vegetable compartment 4 is circulated into the refrigerating compartment 2 via the second sub-duct 92. The air from the second sub-duct 92 is mixed with the air discharged directly from the main duct 9, through opening 22 and the mixed air is circulated to the heat-exchanging compartment 8 via the air duct 20.

The process for circulating air into the refrigerating compartment 2 via the vegetable compartment 4 will be described in detail below.

The air circulated into the vegetable compartment 4 via the first sub-duct 91 flows from the vegetable compartment into the second sub-duct 92. The air is directed into the refrigerating compartment 2 via the opening 92A which is located near the opening 22. The air is directed through the opening 92A into the refrigerating compartment 2 by the difference in pressure between the air which flows directly to the refrigerating compartment 2 and the air which flows through the vegetable compartment 4 and then to the refrigerating compartment 2.

In other words, the air which flows into the vegetable compartment 4 through the first sub-duct 91 becomes warmer, and it is then directed to the opening 92A through the second subduct 92. As the air moves through the duct, it moves slower. However, the speed of the air flowing directly into the refrigerating compartment 2 is somewhat faster than the air circulating through the vegetable compartment 4. Therefore, the pressure of the air which passes through the opening 22 is relatively lower than that of the air which passes through the opening 92A.

When the air circulated through the vegetable compartment 4 is directed through the opening 92A, the air is mixed with the air passing through the opening 22 which has a relatively lower temperature. The mixed air has a uniform temperature which is circulated in the refrigerating compartment 2 to make the foodstuffs cool. The mixed air then flows to the heat-exchanging compartment 8 through the air duct 20 so as to continue the cycle.

The fermentation and storage procedures for kimchi in accordance with the present invention will now be explained below.

Kimchi is a vegetable preparation which includes various seasonings and which is stored in the kimchi compartment 3. As the door 3A is closed, either a high temperature button or low temperature button (not shown) is selected by the user in accordance with the desired kimchi fermentation condition and then the ferment signal is transmitted to a control portion (not shown). In response to a command from the control portion, electrical power is applied to the heating member 32 for a predetermined period of time.

After finishing the kimchi fermentation cycle, the second compressor 102 is activated. The refrigerant in the second compressor 102 flows to the evaporating pipe 31. The air in the kimchi compartment is heat-exchanged which the evaporating pipe 31. The cured kimchi is thus stored at the desired cool temperature.

It will be apparent that the invention, as described above, achieves a more mobile flow of air through the vegetable compartment because the air flows directly into the refrigerating compartment, which has a high discharge velocity which induces the air to pass through the vegetable compartment.

It will further be apparent that the invention, as described above, achieves a satisfactory condition for the storage of foodstuffs for a long period of time as the relative warm air circulated through the vegetable compartment into the refrigerating compartment is mixed with the relatively cool air which flows directly into the refrigerating compartment.

What is claimed is:

1. A refrigerator comprising:

a refrigerating compartment bounded by a wall structure;

a storage compartment separate from said refrigerating compartment and located therebeneath;

air-cooling means for producing cool air; and air circulating means communicating with said air-cooling means for circulating the cool air with respect to said refrigerating and storage compartments, said circulating means including:

a first conducting passage for conducting a first cool air flow to said storage compartment, a second conducting passage for conducting said first cool air flow from said storage compartment to said refrigerating compartment, said second conducting passage extending through said wall structure to communicate with said refrigerating compartment at a first location, and a third conducting passage for conducting a second cool air flow into said refrigerating compartment at a faster speed than said first cool air flow, said third conducting passage extending through said wall structure to communicate with said refrigerating component at a second location closely adjacent to said first location to induce said first cool air flow into said refrigerating compartment.

2. The refrigerator according to claim 1 further comprising a freezing compartment separate from said refrigerating compartment.

3. The refrigerator according to claim 2, wherein said freezing compartment is located above said storage compartment.

4. The refrigerator according to claim 1, wherein said storage compartment comprises a first storage compartment and further comprising a second storage compartment disposed between said refrigerating compartment and said first storage compartment.

5. The refrigerator according to claim 4, wherein said second storage compartment constitutes a kimchi storage compartment having heating and cooling means.

6. The refrigerator according to claim 1, wherein said storage compartment constitutes a vegetable storage compartment.

7. The refrigerator according to claim 1, wherein said second and third conducting passages are arranged to direct said first and second cool air flows into said refrigerating compartment in substantially parallel relationship.

8. The refrigerator according to claim 7, further comprising a door for opening and closing a front portion of said refrigerating compartment, said wall structure of said refrigerating compartment including a rear wall portion disposed opposite said door, both of said first and second locations being disposed in said rear wall portion.

* * * * *